US006969152B2

(12) United States Patent
Kim

(10) Patent No.: US 6,969,152 B2
(45) Date of Patent: Nov. 29, 2005

(54) PRINTING APPARATUS AND ELECTRONIC DEVICE HAVING LINE CONTACT STRUCTURE

(75) Inventor: Dong-sun Kim, Gumi (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 176 days.

(21) Appl. No.: 10/713,352

(22) Filed: Nov. 17, 2003

(65) Prior Publication Data

US 2004/0155945 A1 Aug. 12, 2004

(30) Foreign Application Priority Data

Feb. 7, 2003 (KR) ..... 10-2003-0007936

(51) Int. Cl.[7] ..... B41J 2/01; B41J 2/14; H01R 12/00; H01R 12/06

(52) U.S. Cl. ..... 347/50; 439/67

(58) Field of Search ..... 347/49, 50; 439/66, 439/67, 493, 637; 29/830, 842

(56) References Cited

U.S. PATENT DOCUMENTS 5,515,086 A * 5/1996 Kakizaki et al. ..... 347/50
6,402,526 B1 * 6/2002 Schreiber et al. ..... 439/67
6,536,872 B2 * 3/2003 Goin et al. ..... 347/50

* cited by examiner

*Primary Examiner*—K. Feggins
(74) *Attorney, Agent, or Firm*—Roylance, Abrams, Berdo & Goodman, L.L.P

(57) ABSTRACT

A contact structure for transferring an electrical signal from a main body to a print head, particularly a printing apparatus having a line contact structure, is provided. The printing apparatus comprises an electrical connecting portion formed at an end of the cable; a plurality of contact points formed at the electrical connecting portion, each in a form of a hollow projection so as to correspond to a circuit portion of the print head and having a hole form at an apex of the projection; a fixing portion for fixing the electrical connecting portion to the main body; and an elastic member interposed between the electrical connecting portion and the fixing portion and having a plurality of protruding portions corresponding to the plurality of contact points, wherein the elastic member presses the electrical connecting portion so that the plurality of contact points are in line contact with the circuit portion of the print head when the print head is mounted in the main body.

14 Claims, 6 Drawing Sheets

PRINTING APPARATUS AND ELECTRONIC DEVICE HAVING LINE CONTACT STRUCTURE

This application claims the benefit of Korean Patent Application No. 2003-7936 filed Feb. 7, 2003 in the Korean Intellectual Property Office, the disclosure of which is incorporated herein by reference in its entirety.

BACKGROUND OF THE INVENTION

1. Field of the Invention

The present invention relates to a printing apparatus, and more particularly, to a printing apparatus in which a main body and a print head replaceable with respect to the main body are electrically connected by a flexible cable.

2. Description of the Related Art

Generally, a printing apparatus drives a print head according to input data and prints text or images on a printing paper. The print head is typically connected to a main body by a flexible cable so as to be reciprocated within a certain range. The flexible cable is formed by printing a signal line on a flexible printing plate, whereby an assembling process is facilitated.

There is high demand for a user's convenience in the maintenance of the printing apparatus. When ink is used up in an inkjet printing apparatus, for example, the print head itself, as well as an ink tank, can be replaced with new ones. Thus, the user can use the printing apparatus without concern for the short life span of the print head.

FIG. 1 shows an existing inkjet printing apparatus as an example of the printing apparatus, and FIG. 2 is a view showing a contact structure for connecting a print head to a printing apparatus.

Referring to FIG. 1, in an inkjet printing apparatus 80, a print head 10 integrally formed with an ink tank is mounted in a carriage 50. The carriage 50 performs a printing operation on a printing paper, while moving left and right along a guide rod 60. Further, a feeding unit 70 supplies the printing paper.

Referring to FIG. 2, a flexible cable 20 and an elastic member 30 are affixed to a fixing portion 40 disposed at the carriage 50 of the printing apparatus 80. If the print head 10 is mounted in the carriage 50, a circuit portion 12 (FIG. 4) of the print head 10 is in contact with an electrical connecting portion 21 of the flexible cable 20. The electrical connecting portion 21 (FIG. 3) of the flexible cable 20 is formed with a plurality of contact points 25 and a circuit pattern 23 corresponding to the circuit portion 12 of the print head 10. FIG. 3 is an enlarged view showing one of the contact points 25 formed in the electrical connecting portion 21 and one of protruding portions 32 for supporting the contact point 25 in the elastic member 30. The contact point 25 of the electrical connecting portion 21 is in the form of an empty dome, and the protruding portion 32 of the elastic member 30 is in the form of a cone. The protruding portion 32 of the elastic member 30 is placed in the hollow dome of the contact point 25 so that the contact point 25 is closely contacted with the circuit portion 12 of the print head 10. To this end, the elastic member 30 is formed of an elastic material such as rubber. FIG. 4 is a view showing the contact point 25 of the electrical connecting portion 21 in close contact with the circuit portion 12 of the print head 10 by the protruding portion 32 of the elastic member 30. As shown in FIG. 4, an apex of the contact point 25 of the electrical connecting portion 21 is point-contacted with the circuit portion 12 of the print head 10 so as to press the circuit portion 12 of the print head 10 by the protruding portion 32 of the elastic member 30. Accordingly, due to the point-contact between the circuit portion 12 of the print head 10 and the apex of the contact point 25, an electric signal of the printing apparatus is transferred to the print head 10, and then the print head 10 ejects ink so as to perform the printing operation.

However, because the contact point 25 of the electrical connecting portion 21 of the flexible cable 20 is point-contacted with the print head 10 in the above contact structure, if the protruding portion 32 of the elastic member 30 does not exactly press a center portion of the contact point 25, the contact is uncertain. Thus, the signal from the main body 80 may not be transferred to the print head 10.

In addition, when the electrical connecting portion 21 of the flexible cable 20 is assembled to the elastic member 30, since the contact point 25 of the electrical connecting portion 21 covers the protruding portion 32 of the elastic member 30, there is a problem that it cannot be easily confirmed whether the protruding portion 32 exactly supports the contact point 25, i.e., whether the protruding portion 32 is apart from the center portion of the contact point 25, as shown in FIG. 5A, due to an erroneous assembling or size of the electrical connecting portion 21, or whether the protruding portion 32 is assembled such that an apex of the protruding portion 32 is bent, as shown in FIG. 5B. If the protruding portion 32 does not exactly press the center portion of the contact point 25, a contacting pressure between the contact point 25 and the print head 10 is lowered; therefore, a contact property of the contact point 25 is degenerated. If the contact property of the contact point 25 is degenerated, product quality is also degenerated.

Therefore, a need exists for a printing apparatus in which a circuit portion of a print head is line-contacted with a contact point of an electrical connecting portion, and a worker in an assembly line can confirm, during the assembling of a protruding portion of an elastic member and the contact point when assembling the printing apparatus, that an apex of the protruding portion can be in close contact with the contact point.

SUMMARY OF THE INVENTION

Therefore, it is an object of the present invention to provide a printing apparatus with a contact structure in which a circuit portion of a print head is line-contacted with a contact point of a flexible cable.

It is another object of the present invention to provide a printing apparatus with a line-contact structure, in which an worker in an assembly line can confirm an assembling of a protruding portion of an elastic member with the contact point of the flexible cable, when assembling the printing apparatus, and the protruding portion can be configured in a desired position.

To achieve an aforementioned object of the present invention, a printing apparatus comprising a main body, a print head replaceable with respect to the main body, and a cable for electrically connecting the main body and the print head, wherein a signal from the main body is transferred to the print head, is characterized by comprising an electrical connecting portion formed at an end of the cable; a plurality of contact points formed at the electrical connecting portion and each in a form of a hollow projection, so as to be corresponded to a circuit portion of the print head, and having a hole form at an apex of the projection; a fixing portion for fixing the electrical connecting portion to the main body; and an elastic member interposed between the electrical connecting portion and the fixing portion and having a plurality of protruding portions corresponding to the plurality of contact points, wherein the elastic member presses the electrical connecting portion so that the plurality of contact points are in line contact with the circuit portion of the print head, when the print head is mounted in the main body.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
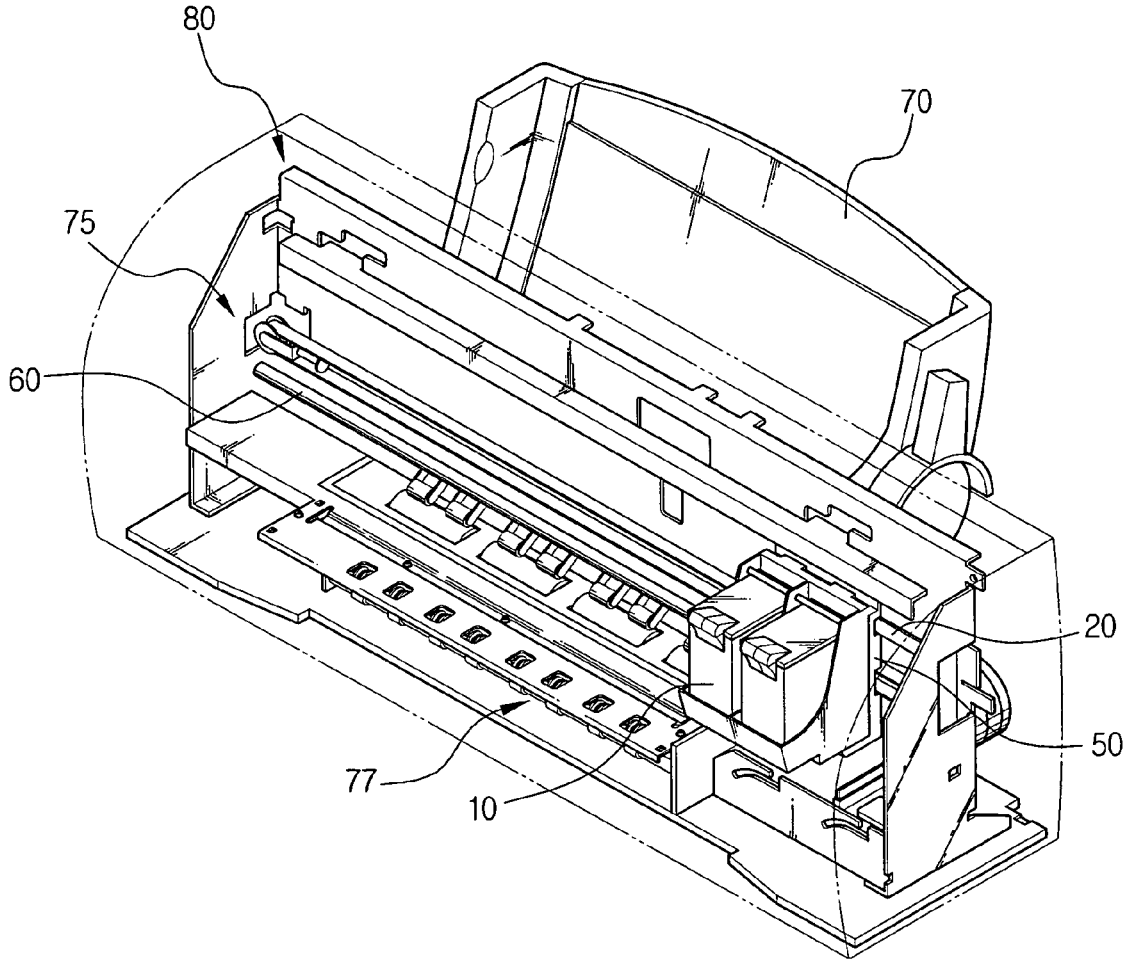
FIG. 1 (PRIOR ART)
FIG. 1 is a perspective view of a conventional printing apparatus with a contact structure between a print head and a main body.

Preferred embodiments of a printing apparatus and an electronic device having a line contact according to the present invention will now be described in detail. An inkjet printing apparatus (hereinafter, called "printing apparatus") that ejects ink on a printing paper to perform a printing operation, as an example of the printing apparatuses, will be described with reference to FIGS. 6 through 10.

Those components of the printing apparatus of the present invention that are the same as the conventional printing apparatus are designated by the same reference numerals.

Figure 2:
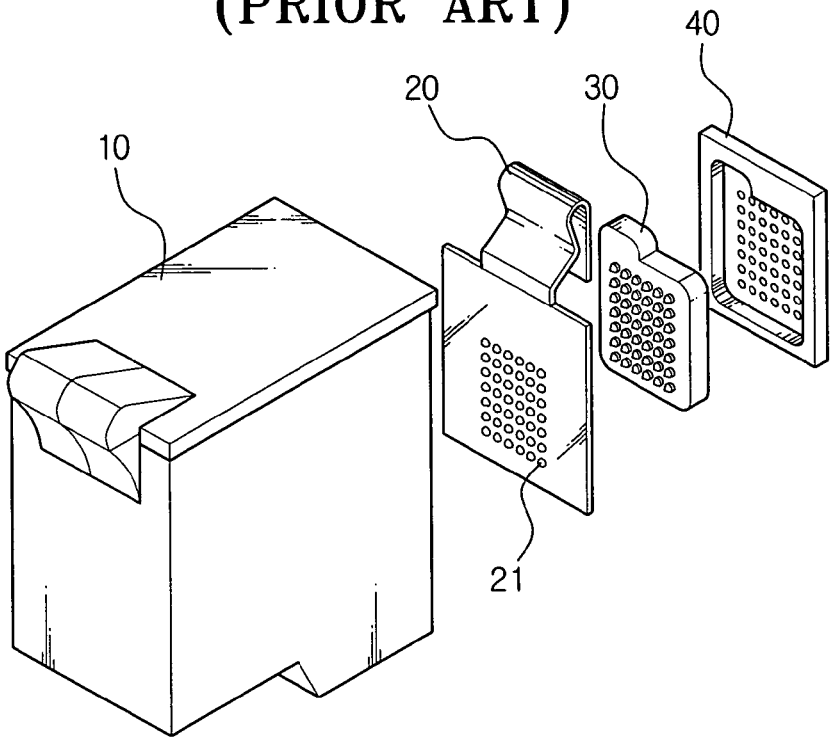
FIG. 2 (PRIOR ART)
FIG. 2 is an exploded perspective view showing the contact structure between a flexible cable and the print head of FIG. 1.
Figure 3:
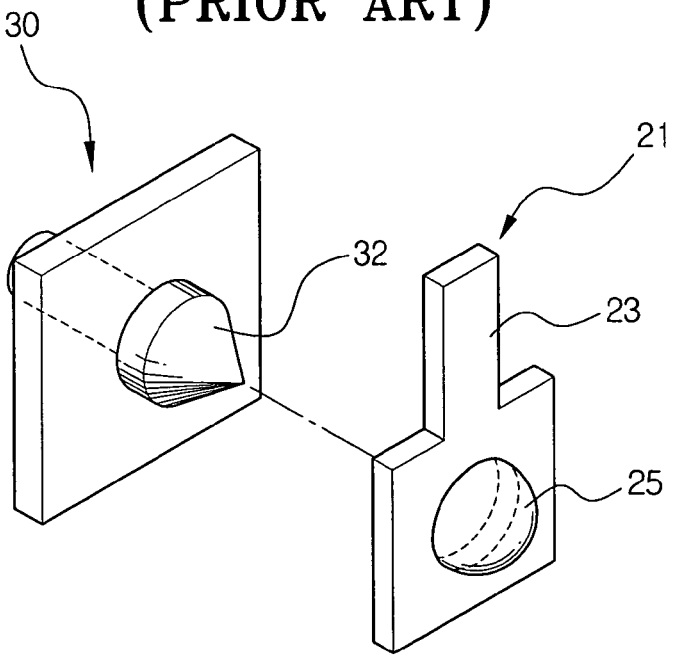
FIG. 3 (PRIOR ART)
FIG. 3 is a perspective view showing structures of a protruding portion of an elastic member and an electrical connecting portion of the flexible cable of FIG. 2.
Figure 4:
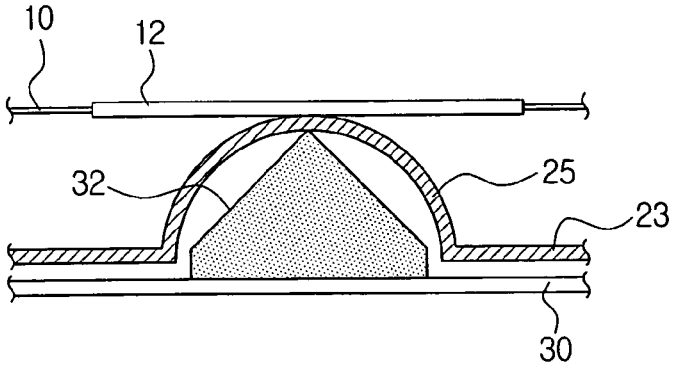
FIG. 4 (PRIOR ART)
FIG. 4 is a partial cross-sectional view showing a contact structure between the protruding portion of the elastic member and the electrical connecting portion of the flexible cable of FIG. 3.

For example, contact structure of a printing apparatus according to the present invention includes a circuit portion 12 of a print head 10, an electrical connecting portion 21 of a flexible cable 20, an elastic member 30 and a fixing portion 40 (FIG. 2).

The circuit portion 12 of the print head 10 is formed with a circuit pattern for connecting the print head 10 with the flexible cable 20, and the print head 10 stores ink and ejects the ink according to a signal of a main body 80 (FIG. 1).

The flexible cable 20 for transferring the signal of the main body 80 to the print head 10 has flexibility to correspond to mobility of a carriage 50, and the electrical connecting portion 21 is formed at an end of the flexible cable 20.

The electrical connecting portion 21 of the flexible cable 20 is disposed at the carriage 50 provided with the print head 10, and formed with a plurality of contact points 100 (FIG. 6) and a circuit pattern 23 for transferring the signal from the main body 80 through the flexible cable 20 to the print head 10. The plurality of contact points 100 is comprised of projections protruded from the circuit pattern 23 of the electrical connecting portion 21, and inside portions of the projections are hollow. Furthermore, at an apex of the contact point 100, there is formed a hole 102. Circumference of the hole 102 is round-processed. Therefore, when the contact point 100 is contacted with the circuit portion 12 of the print head 10, a round-processed portion 103 is line-contacted with the circuit portion 12.

Figure 6:
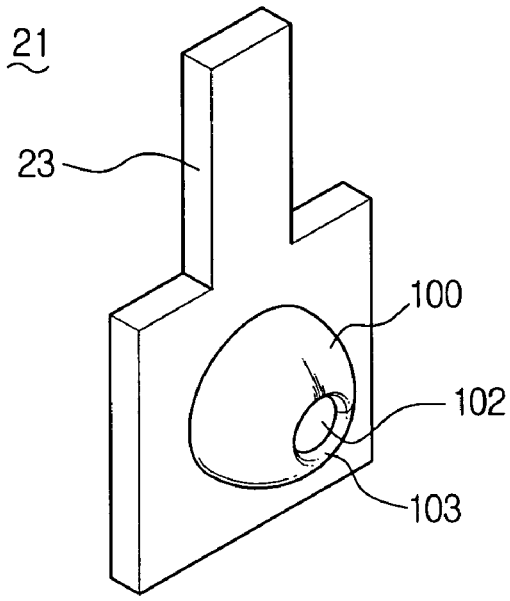
FIG. 6 is a partial enlarged perspective view showing a shape of an electrical connecting portion of a flexible cable according to an embodiment of the present invention.
Figure 7:
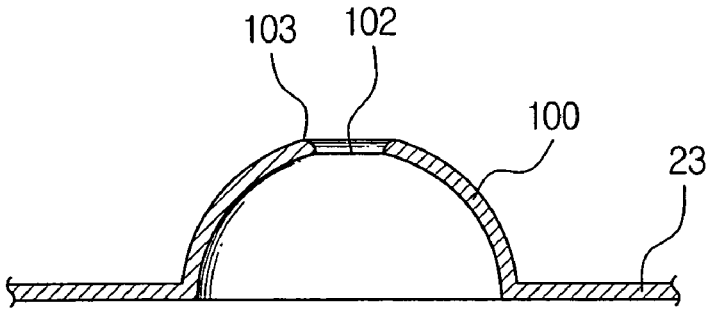
FIG. 7 is a cross-sectional view of the electrical connecting portion of the flexible cable of FIG. 6.

FIG. 6 is a partially enlarged view showing one of the plurality of contact points and a part of the circuit pattern as a preferred embodiment of the contact point of the electrical connecting portion of the flexible cable. Referring to FIG. 6, the contact point 100 is in the form of a dome protruded from the circuit pattern 23, and an inside portion of the dome is hollow. Further, at the apex of the dome, there is formed a circular hole 102. In order to secure the contact between the contact point 100 and the circuit portion 12 (FIG. 10), it is preferable that the circumference of the circular hole 102 formed at the apex of the dome is round-processed, as shown in FIG. 7. Therefore, when the contact point 100 is contacted to the circuit portion 12 of the print head 10, a contacted portion between the contact point 100 and the circuit portion 12 is in the form of a circle. That is, the contact point 100 and the circuit portion 12 of the print head 10 are line-contacted.

Figure 8:
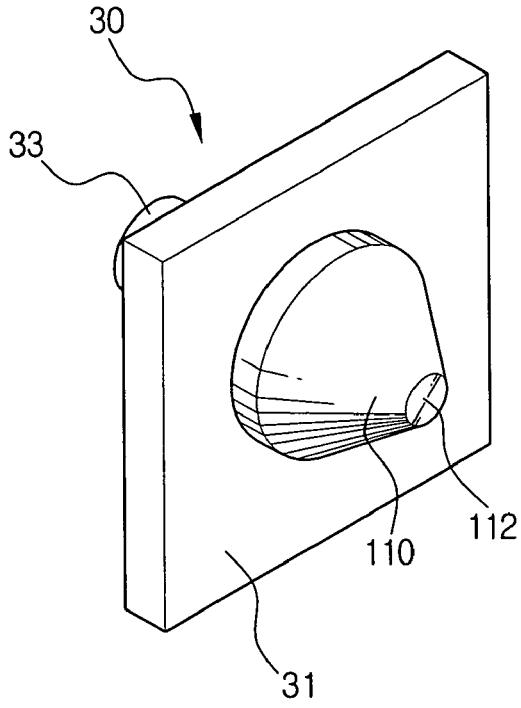
FIG. 8 is a partial enlarged perspective view showing a shape of a protruding portion of an elastic member according to an embodiment of the present invention.
Figure 9:
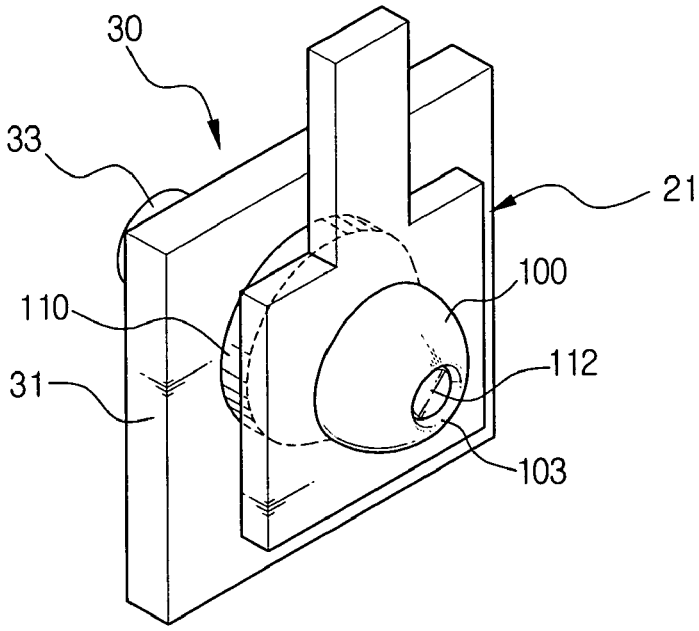
FIG. 9 is a partial enlarged perspective view showing a relationship between the electrical connecting portion of the flexible cable and the protruding portion of the elastic member according to an embodiment of the present invention.
Figure 10:
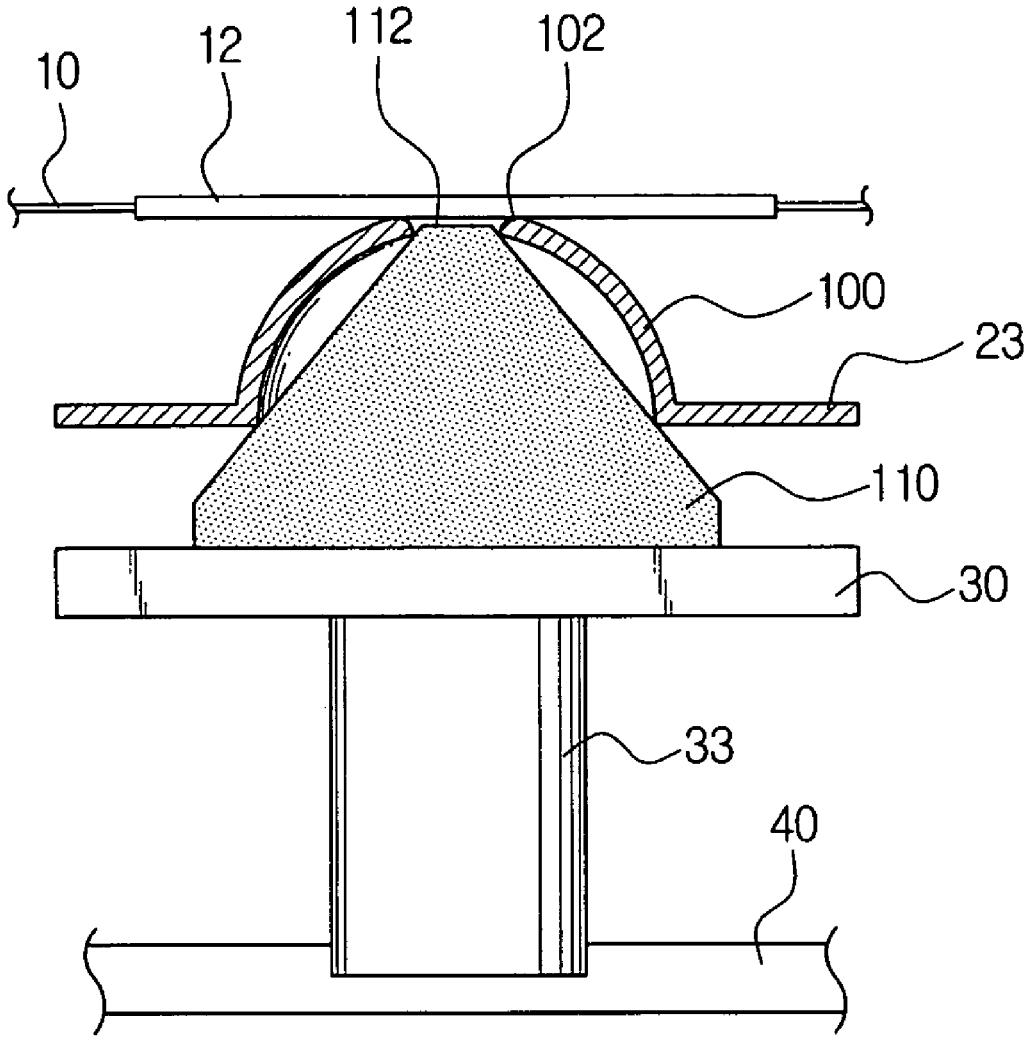
FIG. 10 is a cross-sectional view showing a relationship between the electrical connecting portion of the flexible cable and the protruding portion of the elastic member of FIG. 9.

The elastic member 30 is to press the electrical connecting portion 21 at a desired pressure so that the electrical connecting portion 21 of the flexible cable 20 is closely contacted with the circuit portion 12 of the print head 10. Accordingly, the elastic member 30 is formed of a desired elastic material and has a desired shape to elastically support each contact point 100 of the electrical connecting portion 21. An example of the elastic member 30 is illustrated in FIG. 8. Referring to FIG. 8, the elastic member 30 is comprised of an intermediate plate 31 having a size corresponding to the circuit portion 12 of the print head 10 and a plurality of protruding portions 110 corresponding to the plurality of contact points 100 of the electrical connecting portion 21. In addition, at a lower portion of each protruding portion 110 of the elastic member 30, there is a supporting portion 33 for supporting the protruding portion 110. The protruding portion 110 is in the form of a cone, and an apex 112 of the cone can be inserted into the circular hole 102 of the contact point 100. Furthermore, if the apex 112 of the cone is inserted into the hole 102, a height of the apex 112 of the cone, which is protruded from the hole 102, has to be lower than that of the round-processed portion 103 of the hole 102 in order to prevent the cone from disturbing the contact between the contact point 100 and the circuit portion 12. In other words, there is a space between the apex 112 of the cone and the circuit portion 12 of the print head 10. FIGS. 9 and 10 shows a preferred assembly of the contact point 100 of the electrical connecting portion 21 and the protruding portion 110 of the elastic member 30. It is to be understood that the protruding portion 110 can have any shape in addition to that of FIG. 8, if the shape can press the apex of the contact point 100 of the electrical connecting portion 21 toward the circuit portion 12.

The fixing portion 40 is disposed at a place within the carriage 50, which is contacted with the print head 10, so as to fix the electrical connecting portion 21 of the flexible cable 20 and the elastic member 30 at a desired position. Therefore, when the print head 10 is mounted in the carriage 50, the circuit portion 12 of the print head 10 is contacted with the contact point 100 of the electrical connecting portion 21. At this time, the print head 10 is firmly fixed to the carriage 50 by a fixing member (not shown).

Since the constituents of the inkjet printing apparatus such as a feeding unit 70, a carriage moving unit 75, an exhausting unit 77 are the same as those in the conventional printing apparatus, the description thereof will be omitted.

Herein, an operation of the printing apparatus with a line contact structure according to the present invention, as described above, will be fully described with reference to FIGS. 9 and 10.

Figure 5A:
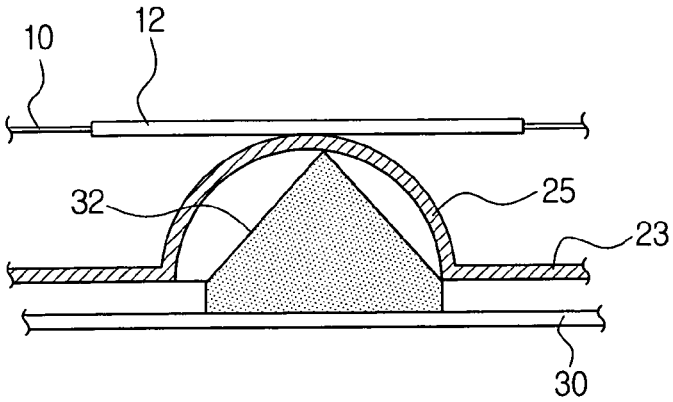
FIG. 5A (PRIOR ART)
FIG. 5A is a partial cross-sectional view showing the protruding portion of FIG. 4 being apart from a center portion of the contact point.
Figure 5B:
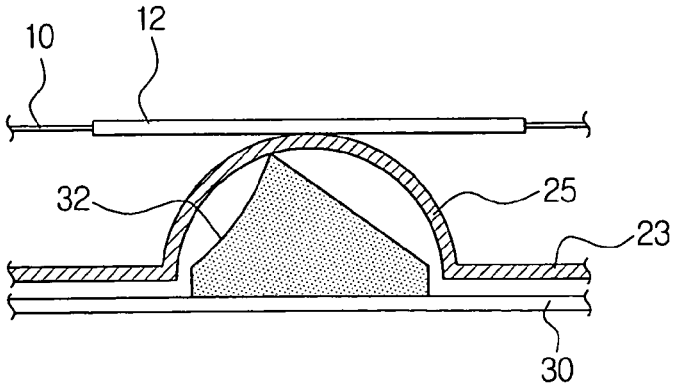
FIG. 5B (PRIOR ART)
FIG. 5B is a partial cross-sectional view showing an apex of the protruding portion that is bent in the contact structure of FIG. 4.

First, a process of mounting the flexible cable 20 in the carriage 50 will be described. The elastic member 30 is disposed at the fixing portion 40 of the carriage 50. The electrical connecting portion 21 of the flexible cable 20 is disposed on the elastic member 30. At this time, the protruding portion 110 of the elastic member 30 is protruded through the circular hole 102 formed at the apex of the contact point 100 of the electrical connecting portion 21. If the protruding portion 110 of the elastic member 30 is not protruded through the hole 102 of the contact point 100, it means that the contact point 100 or the protruding portion has a defect in manufacturing, or the apex of the protruding portion 100 is bent at an inside portion of the contact point 100, as shown in FIG. 5B, when assembling the print apparatus. Therefore, if the protruding portions 110 of the elastic member 30 are protruded through all of the holes 102 of the contact points 100, it means that the elastic member 30 and the electrical connecting portion 21 of the flexible cable 20 are normally assembled.

The print head 10 is disposed in the carriage 50 in which the electrical connecting portion 21 of the flexible cable 20 is mounted, as described above. Then, the circuit portion 12 of the print head 10 is contacted with the contact point 100 of the electrical connecting portion 21 disposed at the fixing portion 40 of the carriage 50. This configuration is illustrated in FIG. 10. Referring to FIG. 10, the apex of the contact point 100, i.e., the round-processed portion 103 (FIG. 9) around the circular hole 102 is contacted with the circuit portion 12. Accordingly, the circuit portion 12 and the contact point 100 are not in point contact with each other, but in line contact with each other, whereby the contact property is promoted. Further, since the apex 112 of the protruding portion 110 of the elastic member 30 is protruded through the hole 102 of the contact point 100, the contact point 100 is contacted with the circuit portion 12, while always pressing the circuit portion 12 at a constant pressure. Thus, the present invention obviates the problem whereby the contact property is degenerated by instability of contact force between the circuit portion 12 and the contact point 100 due to the protruding portion 110 of the elastic member 30 erroneously supporting the contact point 100.

If the print head 10 is disposed in the carriage 50, as described above, a signal is stably transferred from the main body to the print head, and a printing operation is normally performed. After that, although the print head 10 is replaced with a new one due to exhaustion of the ink of the print head 10, since the circuit portion 12 of the print head 10 and the contact point of the flexible cable are stably contacted with each other, the printing operation can be normally performed.

According to the printing apparatus of the present invention having a line contact structure, as described above, since the contact point 100 of the electrical connecting portion 21 is in line contact with the circuit portion 12 of the print head 10, the contact property is improved. Furthermore, since it can be confirmed whether the protruding portions of the elastic member 30 are exactly assembled to the plurality of contact points, the contact points can always press the circuit portion 12 of the print head 10 at the constant pressure, and thus the contact property is not degenerated. Therefore, the present invention obviates the problem of a printing defect due to loose contact between the print head 10 and the electrical connecting portion 21.

The printing apparatus having a line contact structure according to the present invention can be applied to all of the printing apparatuses in which the print head 10 is separated from the main body. Further, the line contact structure of the present invention can be also applied to all kinds of electronic devices having a replaceable component which is can be replaced with respect to a main body and a structure for transferring an electric signal to the replaceable component and performing a specific function.

While the present invention has been described in detail, it should be understood that various changes, substitutions and alterations can be made hereto without departing from the spirit and scope of the invention as defined by the appended claims.

What is claimed is:

1. A printing apparatus comprising a main body, a print head replaceable with respect to the main body, and a cable for electrically connecting the main body and the print head, wherein a signal from the main body is transferred to the print head, the printing apparatus comprising:

an electrical connecting portion formed at an end of the cable;

a plurality of contact points formed at the electrical connecting portion, each in a form of a hollow projection so as to correspond to a circuit portion of the print head and having a hole formed at an apex of the projection;

a fixing portion for fixing the electrical connecting portion to the main body; and an elastic member interposed between the electrical connecting portion and the fixing portion and having a plurality of protruding portions corresponding to the plurality of contact points, wherein the elastic member presses the electrical connecting portion so that the plurality of contact points are in line contact with the circuit portion of the print head when the print head is mounted in the main body.

2. The printing apparatus of claim 1, wherein the hole formed at the apex of each of the contact points is round-processed.

3. The printing apparatus of claim 2, wherein each of the plurality of contact points are a dome-shaped hollow projection.

4. A printing apparatus comprising a main body, a print head replaceable with respect to the main body, and a cable for electrically connecting the main body and the print head, wherein a signal from the main body is transferred to the print head, the printing apparatus comprising:

an electrical connecting portion formed at an end of the cable;

a plurality of contact points formed at the electrical connecting portion, each in a form of a hollow projection so as to correspond to a circuit portion of the print head and having a hole form at an apex of the projection;

a fixing portion for fixing the electrical connecting portion to the main body; and an elastic member interposed between the electrical connecting portion and the fixing portion and having a plurality of protruding portions inserted into the holes formed at the plurality of contact points, wherein the elastic member presses the electrical connecting portion so that the plurality of contact points are in line contact with the circuit portion of the print head when the print head is mounted in the main body.

5. The printing apparatus of claim 4, wherein the hole formed at the apex of each of the contact points is round-processed.

6. The printing apparatus of claim 5, wherein each of the plurality of contact points are a dome-shaped hollow projection.

7. The printing apparatus of claim 6, wherein the protruding portion of the elastic member is in a form of a cone, and a space is formed between an apex of the cone and the circuit portion of the print head when the apex of the cone is inserted into the hole of the dome.

8. An electronic device comprising a main body, a replaceable component which is replaceable with respect to the main body, and a cable for electrically connecting the main body and the replaceable component, wherein a signal from the main body is transferred to the replaceable component, the electronic device comprising:

an electrical connecting portion formed at an end of the cable;

a plurality of contact points formed at the electrical connecting portion, each in a form of a hollow projection so as to correspond to a circuit portion of the replaceable component and having a hole form at an apex of the projection;

a fixing portion for fixing the electrical connecting portion to the main body; and an elastic member interposed between the electrical connecting portion and the fixing portion and having a plurality of protruding portions corresponding to the plurality of contact points, wherein the elastic member presses the electrical connecting portion so that the plurality of contact points are in line contact with the circuit portion of the replaceable component when the replaceable component is mounted in the main body.

9. The electronic device of claim 8, wherein the hole formed at the apex of each of the contact points is round-processed.

10. The electronic device of claim 9, wherein each of the plurality of contact points are a dome-shaped hollow projection.

11. An electronic device comprising a main body, a replaceable component which is replaceable with respect to the main body, and a cable for electrically connecting the main body and the replaceable component, wherein a signal from the main body is transferred to the replaceable component, the electronic device comprising:

an electrical connecting portion formed at an end of the cable;

a plurality of contact points formed at the electrical connecting portion, each in a form of a hollow projection so as to correspond to a circuit portion of the replaceable component and having a hole form at an apex of the projection;

a fixing portion for fixing the electrical connecting portion to the main body; and an elastic member interposed between the electrical connecting portion and the fixing portion and having a plurality of protruding portions inserted into the holes formed at the plurality of contact points, wherein the elastic member presses the electrical connecting portion so that the plurality of contact points are in line contact with the circuit portion of the replaceable component when the replaceable component is mounted in the main body.

12. The electronic device of claim 11, wherein the hole formed at the apex of each of the contact points is round-processed.

13. The electronic device of claim 12, wherein each of the plurality of contact points are a dome-shaped hollow projection.

14. The electronic device of claim 13, wherein the protruding portion of the elastic member is in a form of a cone, and a space is formed between an apex of the cone and the circuit portion of the replaceable component when the apex of the cone is inserted into the hole of the dome.

* * * * *